United States Patent [19]

Baum

[11] 4,246,318

[45] Jan. 20, 1981

[54] THERMALLY-RESPONSIVE RECORD MATERIAL

[75] Inventor: Henry H. Baum, Appleton, Wis.

[73] Assignee: Appleton Papers Inc., Appleton, Wis.

[21] Appl. No.: 28,630

[22] Filed: Apr. 9, 1979

[51] Int. Cl.[2] ..... B41M 5/18

[52] U.S. Cl. ..... 428/411; 282/27.5; 427/151; 427/153; 428/323; 428/500; 428/532; 428/535; 428/913

[58] Field of Search ..... 106/21; 282/27.5; 427/148, 150, 151, 153; 428/307, 411, 537, 913, 914, 264, 323, 500, 532, 535

[56] References Cited

U.S. PATENT DOCUMENTS

| | | | |
|---|---|---|---|
| 3,451,338 | 6/1969 | Baum | 427/148 |
| 3,539,375 | 11/1970 | Baum | 428/913 X |
| 3,674,535 | 7/1972 | Blose et al. | 428/452 |
| 3,775,424 | 11/1973 | Farber | 546/116 |
| 3,853,869 | 12/1974 | Farber | 546/307 X |

*Primary Examiner*—Bruce H. Hess

*Attorney, Agent, or Firm*—E. Frank McKinney; Paul S. Phillips, Jr.

[57] ABSTRACT

A thermally sensitive record material is disclosed which comprises chromogenic material which is a mixture of the isomers 7-(1-ethyl-2-methylindol-3-yl)-7-(4-dimethylamino-2-ethoxyphenyl)-5,7-dihydrofuro[3,4-b]pyridin-5-one and 5-(1-ethyl-2-methylindol-3-yl)-5-(4-diethylamino-2-ethoxyphenyl)-5,7-dihydrofuro[3,4-b]pyridin-7-one. This record material has superior color forming efficiency and greater image stability, especially resistance to fading in incident light.

12 Claims, No Drawings

THERMALLY-RESPONSIVE RECORD MATERIAL

TECHNICAL FIELD

This invention pertains to record media on which data are developed in response to an application of heat. It more particularly relates to such record media in the form of sheets coated with color-forming systems comprising the chromogenic material Pyridyl Blue. Pyridyl Blue is a mixture of the isomers 7-(1-ethyl-2-methylindol-3-yl)-7-(4-diethylamino-2-ethoxyphenyl)-5,7-dihydrofuro[3,4-b]pyridin-5-one and 5-(1-ethyl-2-methylindol-3-yl)-5-(4-diethylamino-2-ethoxyphenyl)-5,7-dihydrofuro[3,4-b]pyridin-7-one.

This invention particularly concerns a thermally-responsive record material with improved color forming efficiency and greater stability, especially resistance to fading in incident light.

BACKGROUND ART

Certain pyridine and pyrazine compounds, closely related to Pyridyl Blue, have been disclosed in U.S. Pat. Nos. 3,775,424 and 3,853,869. Likewise, Japanese Kokai No. 75-05116 (*Chem. Abstracts,* Vol. 83, 35759v, 1975), Japanese Kokai No. 75-03426 (*Chem. Abstracts,* Vol. 83, 29895v, 1975) and Japanese Kokai No. 74-118515 (*Chem. Abstracts,* Vol. 82, 178280x, 1974) teach similar chromogenic compounds. Copending applications for U.S. Letters Patent Ser. No. 375, filed Dec. 29, 1978, by Robert E. Miller and Ser. No. 365, filed Dec. 29, 1978, by Bruce W. Brockett, both applications having a common assignee with the present application, disclose to the use of the chromogenic material Pyridyl Blue in pressure-sensitive record materials. None of these references disclose the use of Pyridyl Blue in a thermally-responsive record material composition necessary to achieve the objectives of the present invention.

U.S. Pat. No. 3,539,375 issued Nov. 10, 1970, on an application of the inventor herein, discloses a thermally-responsive record material wherein a color-forming system comprising minute particles of each of crystal violet lactone (CVL) and a phenolic material distributed in a polyvinyl alcohol film matrix.

U.S. Pat. Nos. 3,674,535, issued July 4, 1972, and 3,746,675, issued July 17, 1973, disclose a thermally-responsive record material system which has a similar color-forming system to that disclosed in U.S. Pat. No. 3,539,375 as previously described. These patents additionally disclose the use of fillers, lubricants and waxes which do not enter into the color forming reaction but are added to lower the cost of the coating, to prevent sticking of the coating when heated, to lubricate the coating when calendered to increase its smoothness, or, in the case of certain waxes, to lower the reaction temperature of the color-forming system.

In the field of thermally-responsive recording materials, there is considerable demand for a product with improved image stability.

CVL is commonly used in commerical thermally-responsive recording materials, but to achieve an acceptable level of image stability, a specific polymeric film matrix must be utilized.

It is an object of the present invention to provide a thermally-responsive recording material having improved image stability. It is a further object of this invention to provide such a recording material possessing improved image stability without the necessity of using a specific polymeric film matrix.

It is also an object of this invention to provide a thermally-responsive recording material possessing increased image color-forming efficiency.

The color-forming system of the record material of this invention comprises the basic chromogenic material Pyridyl Blue in its colorless state, and an acidic phenolic material. The color-forming system relies upon melting or subliming (vaporizing of solid particles) one or more of the components to achieve reactive, color-producing, contact.

The record material includes a substrate or support material which is generally in sheet form. For purposes of this invention, sheets also mean webs, ribbons, tapes, belts, films, cards and the like. Sheets denote articles having two large surface dimensions and a comparatively small thickness dimension. The substrate or support material can be opaque, transparent or translucent and could, itself, be colored or not. The material can be fibrous including, for example, paper and filamentous synthetic materials. It can be a film including, for example, cellophane and synthetic polymeric sheets cast, extruded, or otherwise formed. The gist of this invention resides in the color-forming system coated on the substrate. The kind or type of substrate material is not critical.

The components of the color-forming system are in a contiguous relationship, substantially homogeneously distributed throughout the coated layer material deposited on the substrate. In manufacturing the record material, a coating composition is prepared which includes a fine dispersion of the components of the color-forming system, polymeric binder material, surface active agents and other additives in an aqueous coating medium. The composition can additionally contain inert pigments, such as clay, talc and calcium carbonate; synthetic pigments, such as urea-formaldehyde resin pigments; natural waxes such as Carnauba wax; synthetic waxes; lubricants such as zinc stearate; wetting agents and defoamers.

The color-forming system components are substantially insoluble in the dispersion vehicle (preferably water) and are ground to an individual average particle size of between about 1 micron to 10 microns, preferably about 3 microns. The polymeric binder material is substantially vehicle soluble although latexes are also eligible in some instances. Preferred water soluble binders include poly(vinylalcohol), hydroxy ethylcellulose, methylcellulose, isopropyl cellulose, starch, modified starches, gelatin and the like. Eligible latex materials include polyacrylates, polyvinylacetates, polystyrene, and the like. The polymeric binder is used to protect the coated materials from brushing and handling forces occasioned by storage and use of the thermal sheets. Binder should be present in an amount to afford such protection and in an amount less than will interfere with achieving reactive contact between color-forming reactive materials. An effective sheet is made with about 1 to about 30 weight percent binder in the dried coating composition. The binder is preferably present at 5 to 30 weight percent of the dried coating.

Coating weights can effectively be about 1.5 to about 8 grams per square meter and preferably about 3 to about 6 grams per square meter. The practical minimum amount of color-forming materials is controlled by economic considerations, functional parameters and desired handling characteristics of the coated sheets.

The color-forming system relies on fusion (melting) or sublimation (vaporization of solid particles) of one or more components. The system utilizes acidic materials, such as phenolic compounds, Pyridyl Blue and, if desired, additional basic chromogenic materials which react with acidic materials. Such additional basic compounds are added for the purpose of shading the resulting image color and include materials with a lactone ring, for example, phthalides or fluorans. Examples of eligible acid material include the compounds listed in U.S. Pat. No. 3,451,338 as phenolic reactive materials, particularly the monophenols and diphenols. The list is exemplary only and not intended to be exhaustive: 4-t-butyl-phenol, 4-phenylphenol, methyl-4-hydroxybenzoate, 4-hydroxyacetophenone, 4-t-octylcatechol, 2,2'-dihydroxydiphenyl, 2,2'-methylenebis-(4-chlorophenol), 2,2'-methylenebis-(4-methyl-6-t-butylphenol), 4,4'-isopropylidenediphenol (Bisphenol A), 4,4'-isopropylidenebis-(2-chlorophenol), 4,4'-isopropylidenebis-(2,6-dibromophenol), 4,4'-isopropylidenebis-(2,6-dichlorophenol), 4,4'-isopropylidenebis-(2-methylphenol), 4,4'-isopropylidenebis-(2,6-dimethylphenol), 4,4'-isopropylidenebis-(2-t-butylphenol), 4,4'-sec.-butylidenebis-(2-methylphenol), 4,4'-cyclohexylidenediphenol, 4,4'-cyclohexylidene-bis-(2-methylphenol), 2,2'-thiobis-(4,6-dichlorophenol), 4,4'-thiodiphenol, and the like. Most preferred among the phenolic reactive materials are Bisphenol A, 4,4'-thiodiphenol and 4-phenylphenol. Other acid compounds of other kinds and types are eligible. Examples of such other compounds are phenolic novolak resins which are the product of reaction between, for example, formaldehyde and a phenol such as an alkylphenol, e.g., p-octylphenol, or other phenols such as p-phenylphenol, and the like; and acid mineral materials including colloidal silica, kaolin, bentonite, attapulgite, halloysite, and the like. Some of the polymers and minerals do not melt but undergo color reaction on fusion of the chromogen.

The eligible additional basic chromogenic compounds, such as the phthalide, leucauramine and fluoran compounds, for use in the color-forming system are well known color-forming compounds. Examples of the compounds include Crystal Violet Lactone (3,3-bis(4-dimethyl-aminophenyl)-6-dimethylamino phthalide (U.S. Pat. No. Re 23, 024); phenyl-, indol-, pyrol-, and carbazol-substituted phthalides (for example, in U.S. Pat. Nos. 3,491,111; 3,491,112; 3,491,116; 3,509,174); nitro-, amino-, amido-, sulfon amido-, aminobenzylidene-, halo-, anilino-substituted fluorans (for example, in U.S. Pat. Nos. 3,624,107; 3,627,787; 3,641,011; 3,642,828; 3,681,390). Other specifically eligible chromogens, not limiting the invention in any way, are: 6'-diethylamino-1',2'-benzofluoran; 3,3-bis(1-ethyl-2-methyl-indol-3-yl)phthalide; 6'-diethyllamino-2'-anilinofluroan; 6'-diethyl-amino-2'-benzyl-aminofluoran; 6'-diethylamino-2'-butoxyfluoran; and 6'-diethylamino-2'-bromo-3'-methylfluoran.

The Pyridyl Blue chromogenic compound utilized in the examples is made according to the following procedure:

A quantity of 58.0 g (0.188 mole) of (1-ethyl-2-methylindol-3-yl)-(3-carboxypyridin-2-yl)ketone and its isomer is stirred 2 hours at 60°-65° C. with 35.3 g (0.188 mole) of N,N-diethyl-m-phenetidine and 250 ml. of acetic anhydride.

The reaction mixture is poured into 500 ml. of water and the acetic anhydride hydrolyzed by slowly adding 450 ml. of 29% ammonium hydroxide. After stirring 2 hours the resulting solid is filtered. It is washed with water, 200 ml. of 40% methanol/water and 50 ml. of petroleum ether (b.P 60°-110° C.).

The solid is dried in a 75° C. oven to a constant weight of 80.5 g. (90%) of a desired product, mp. 134°-137° C.

The material can be recrystallized from a toluene-petroleum ether mixture to yield a product with a melting point of 160°-162° C. The product of this purification is not required for the practice of the invention but it does result in a color-forming system with improved background color.

The temperature at which the color is generated, in the practice of this invention, is important only in that the color-forming temperature must be within some reasonable range of intended operation.

BEST MODE FOR CARRYING OUT THE INVENTION

In the following comparative example and the numbered examples illustrating the present invention all parts are parts by weight and all measurements are in the metric system, unless otherwise stated.

In the comparative example and in all examples illustrating the present invention a dispersion of a particular system component was prepared by milling the component in an aqueous solution of the binder until a particle size of between about 1 micron and 10 microns was achieved. The milling was accomplished in an attritor. The desired average particles size was about 3 microns in each dispersion.

In these examples separate dispersions comprising the basic chromogenic compound (Component A), and the phenolic reactive material (Component B) were prepared. Component A and Component B were combined to produce a coating mixture with the desired ratio of materials. In some cases additional binder was added. These coating mixtures were applied to paper and dried at a weight of about 3.7 to 5.2 grams per square meter dry coat weight.

| Material | Parts |
|---|---|
| Component A | |
| Chromogenic compound | 42.5 |
| Binder | 7.5 |
| Water | 200.0 |
| Defoamer | 0.1 |
| Component B | |
| Phenolic compound | 35.0 |
| Binder | 12.0 |
| Inert Materials | 33.0 |
| Water | 320.0 |
| Defoamer | 0.2 |

The compositions of the dry coatings prepared from mixtures of Component A and Component B are presented in Table I. The inert materials in Component B consisted of a mixture of kaolin clay, zinc stearate and Acra Wax C (a reaction product of hydrogenated castor oil). The defoamer used for each of the dispersions consisted of a mixture of 1 part Nopco NDW (a defoaming agent produced by Nopco Chemical Company) and 4 parts Surfynol 104 (a di-tertiary acetylene glycol surface active agent produced by Air Reduction Chemical Company).

Table I

| Example | Chromogenic Compound Type | Chromogenic Compound Wt. Percent | Phenolic Compound Type | Phenolic Compound Wt. Percent | Binder Type | Binder Wt. Percent | Wt. Percent Kaolin Clay |
|---|---|---|---|---|---|---|---|
| 1 | Pyridyl Blue | 6% | Bisphenol A | 40% | Poly(vinyl-Alcohol) | 30% | 20% |
| 2 | Pyridyl Blue | 6% | Bisphenol A | 40% | Methyl Cellulose | 15% | 35% |
| 3 | Pyridyl Blue | 6% | Bisphenol A | 40% | Methyl Hydroxy-propyl Cellulose | 10% | 40% |
| 4 | Pyridyl Blue | 6% | Bisphenol A | 40% | Hydroxy-ethyl Cellulose | 15% | 35% |
| 5 | Pyridyl Blue | 3% | Bisphenol A | 40% | Hydroxy-ethyl Cellulose | 15% | 38% |
| 6 | Pyridyl Blue | 3% | Bisphenol A | 40% | Modified Corn Starch | 15% | 38% |
| 7 | Pyridyl Blue | 3% | Bisphenol A | 40% | Poly(vinyl-Alcohol) Methyl Cellulose | 15% 1% | 37% |
| Comparative Example | Crystal Violet Lactone | 6% | Bisphenol A | 40% | Poly(vinyl-Alcohol) | 30% | 20% |

Each of the examples also contained 2% zinc stearate and 2% Acra Wax C.

The thermally-sensitive record material sheets coated with the mixtures of Component A and Component B were imaged by contacting the coated sheet with a metallic imaging block at the indicated temperature for five seconds. The intensity of each image was measured by means of a reflectance reading using a Bausch & Lomb Opacimeter. A reading of 92 indicates no discernable image and a low value indicates good image development.

After determination of the image intensity, each of the images was exposed to fluorescent light irradiation. The fluorescent light test device comprised a light box containing a bank of daylight fluorescent lamps (21 inches long, 13 nominal lamp watts) vertically mounted on 1-inch centers placed 1½ inches from the sample being exposed.

After fluorescent light exposure of the images for 65 hours the intensity of each image was again measured in the Opacimeter.

These intensity data and fade data for the examples are presented in Table II.

Table II

| Example | 300° Before | 300° After | 275° Before | 275° After | 260° Before | 260° After | 245° Before | 245° After |
|---|---|---|---|---|---|---|---|---|
| | Reflectance Intensity of Image Developed at Indicated Fahrenheit Temperature. Intensity Measured Before and After Light Exposure | | | | | | | |
| 1 | 7.1 | 7.6 | 8.1 | 9.5 | 9.5 | 11.9 | 12.8 | 16.9 |
| 2 | 5.5 | 5.6 | 5.5 | 5.8 | 5.5 | 6.0 | 6.2 | 7.4 |
| 3 | 5.4 | 5.6 | 5.3 | 5.6 | 5.6 | 6.2 | 7.1 | 8.5 |
| 4 | 6.7 | 7.1 | 6.7 | 7.4 | 7.2 | 8.4 | 8.8 | 11.7 |
| 5 | 9.4 | 9.8 | 8.9 | 9.8 | 9.9 | 12.0 | 12.3 | 16.0 |
| 6 | 7.1 | 8.2 | 8.2 | 9.8 | 9.0 | 11.2 | 11.0 | 15.2 |
| 7 | 7.8 | 8.3 | 9.1 | 11.0 | 10.1 | 13.9 | 13.2 | 20.3 |
| Comparative Example | 9.1 | 34.5 | 13.4 | 35.1 | 15.1 | 36.9 | 19.6 | 42.5 |

From the data of Table II it is readily apparent that thermally-responsive recording materials employing Pyridyl Blue produce more intense images at equal parts by weight and produce equal image intensity at lower parts by weight than does a thermally-responsive recording material employing Crystal Violet Lactone (CVL), the chromogenic compound most widely used in commercial applications. Also the data of Table II indicate a fade resistance of the Pyridyl Blue image far superior to the CVL image, even when the CVL is in the presence of Polyvinyl Alcohol, a material which enhances the stability of the CVL image. Additionally, the superior stability of the Pyridyl Blue image is independent of the type of binder material utilized.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A thermally-responsive record material comprising a substrate coated with finely divided solid Pyridyl Blue and a finely divided phenolic material held in contiguous relationship by a binder present in said coating in an amount of about 1 to about 30 weight percent whereby the melting or sublimation of either finely divided material produces a mark-forming reaction upon reactive contact.

2. The record material of claim 1 in which the phenolic material is selected from the group consisting of 4,4'-isopropylidenediphenol, 4,4'-thiodiphenol and 4-phenylphenol.

3. The record material of claim 2 in which the phenolic material is 4,4'-isopropylidenediphenol.

4. The record material of claim 1 in which said binder is present in said coating in an amount of 5 to 30 weight percent.

5. The record material of claim 1 in which the binder material is selected from the group consisting of poly(-vinylalcohol), methylcellulose, methyl-hydroxypropyl-cellulose, starch, hydroxyethylcellulose and mixtures thereof.

6. The record material of claim 5 in which the binder material is a mixture of poly(vinylalcohol) and methyl-cellulose.

7. The record material of claim 1 in which the Pyridyl Blue is present in said coating in an amount of 0.5 to 10 weight percent.

8. The record material of claim 7 in which the Pyridyl Blue is present in said coating in an amount of 3 to 6 weight percent.

9. A thermally-responsive record material in accordance with claim 1, which further comprises a pigment.

10. A thermally-responsive record material in accordance with claim 9, wherein the pigment is clay.

11. A thermally-responsive record material in accordance with claim 10, wherein the pigment is kaolin clay.

12. A thermally-responsive record material in accordance with claim 9, wherein the pigment is urea-formaldehyde resin pigment.

* * * * *

UNITED STATES PATENT AND TRADEMARK OFFICE

CERTIFICATE OF CORRECTION

PATENT NO. : 4,246,318
DATED : January 20, 1981
INVENTOR(S) : Henry H. Baum

It is certified that error appears in the above-identified patent and that said Letters Patent are hereby corrected as shown below:

Abstract, lines 3, 4 and 5, change "7-(1-ethyl-2-methylindol-3-yl)-7-(4-dimethylamino-2-ethoxyphenyl)-5,7-dihydrofuro[3,4-b]pyridin-5-one" to -- 7-(1-ethyl-2-methylindol-3-yl)-7-(4-diethylamino-2-ethoxyphenyl)-5,7-dihydrofuro[3,4-b]pyridin-5-one --.

Signed and Sealed this

Sixth Day of April 1982

[SEAL]

*Attest:*

GERALD J. MOSSINGHOFF

*Attesting Officer* *Commissioner of Patents and Trademarks*